US006149451A

United States Patent [19]

Weber

[11] Patent Number: 6,149,451

[45] Date of Patent: Nov. 21, 2000

[54] CABLE CONNECTOR LATCHING DEVICE

[75] Inventor: Ryan T. Weber, Orem, Utah

[73] Assignee: ATL Technology, Inc., Orem, Utah

[21] Appl. No.: 09/320,474

[22] Filed: May 26, 1999

Related U.S. Application Data

[60] Provisional application No. 60/089,167, Jun. 12, 1998.

[51] Int. Cl.[7] ..... H01R 13/627

[52] U.S. Cl. ..... 439/358

[58] Field of Search ..... 439/358, 923, 439/357, 350

[56] References Cited

U.S. PATENT DOCUMENTS

| | | | |
|---|---|---|---|
| 4,002,389 | 1/1977 | Mammel . | |
| 4,341,428 | 7/1982 | Hatch et al. . | |
| 4,345,813 | 8/1982 | Hatch . | |
| 4,376,563 | 3/1983 | Margrave et al. . | |
| 4,544,225 | 10/1985 | Raus et al. . | |
| 4,702,542 | 10/1987 | Noyes | 439/347 |
| 4,842,542 | 6/1989 | Davis . | |
| 4,904,202 | 2/1990 | Uchida | 439/372 |
| 4,961,711 | 10/1990 | Fujiura et al. . | |
| 5,004,430 | 4/1991 | DelGuidice et al. . | |
| 5,011,424 | 4/1991 | Simmons . | |
| 5,104,334 | 4/1992 | Honma et al. . | |
| 5,144,424 | 9/1992 | Simmons . | |
| 5,167,523 | 12/1992 | Crimmins et al. | 439/350 |
| 5,178,556 | 1/1993 | Chen . | |
| 5,197,109 | 3/1993 | Hashiguchi . | |
| 5,197,900 | 3/1993 | Ellis et al. . | |
| 5,197,901 | 3/1993 | Hashiguchi | 439/352 |
| 5,295,855 | 3/1994 | Walz . | |
| 5,334,041 | 8/1994 | Anbo et al. . | |
| 5,340,329 | 8/1994 | Hirai | 439/357 |
| 5,383,794 | 1/1995 | Davis et al. . | |
| 5,438,752 | 8/1995 | Chang . | |
| 5,486,117 | 1/1996 | Chang | 439/357 |
| 5,545,052 | 8/1996 | Hirai . | |
| 5,567,969 | 10/1996 | Hall . | |
| 5,599,199 | 2/1997 | Wright . | |
| 5,611,581 | 3/1997 | Ghostley . | |
| 5,611,708 | 3/1997 | Mizunuma et al. . | |
| 5,620,212 | 4/1997 | Bourne . | |
| 5,630,507 | 5/1997 | Baker . | |
| 5,639,255 | 6/1997 | Muzslay . | |
| 5,641,300 | 6/1997 | Corrion . | |
| 5,647,578 | 7/1997 | Bivens . | |
| 5,655,799 | 8/1997 | Takimoto . | |
| 5,660,558 | 8/1997 | Osanai et al. . | |
| 5,667,258 | 9/1997 | Takimoto . | |
| 5,690,372 | 11/1997 | Jans . | |
| 5,713,752 | 2/1998 | Leong et al. | 439/358 |
| 5,716,228 | 2/1998 | Chen | 439/358 |
| 5,741,150 | 4/1998 | Stinson et al. | 439/358 |
| 5,860,826 | 1/1999 | Chang | 439/358 |

FOREIGN PATENT DOCUMENTS

| | | |
|---|---|---|
| 165700 | 4/1980 | China . |

*Primary Examiner*—Khiem Nguyen
*Assistant Examiner*—Hae Moon Hyeon
*Attorney, Agent, or Firm*—John R. Wahl; Gregory P. Durbin; Holland & Hart LLP

[57] ABSTRACT

A cable connector is described which includes a latch assembly that is adjustable with regard to the retention force necessary to disengage the connector from a receptacle to which the connector is attached. The latch assembly comprises a thumb tab and a sheet metal latch member and may or may not include a separate pivot pin. One embodiment of the latch assembly includes a separate spring pivot pin. Another embodiment includes a separate pivot pin and a third embodiment eliminates the separate pivot pin all together by forming the pivot pin from the sheet metal latch member. The connector housing preferably includes a blind slot in the upper and lower walls of a through channel receiving the latch assembly and which terminates at the pivot location. Each blind slot preferably includes a constriction adjacent the pivot location to retain the pivot pins in position.

18 Claims, 5 Drawing Sheets

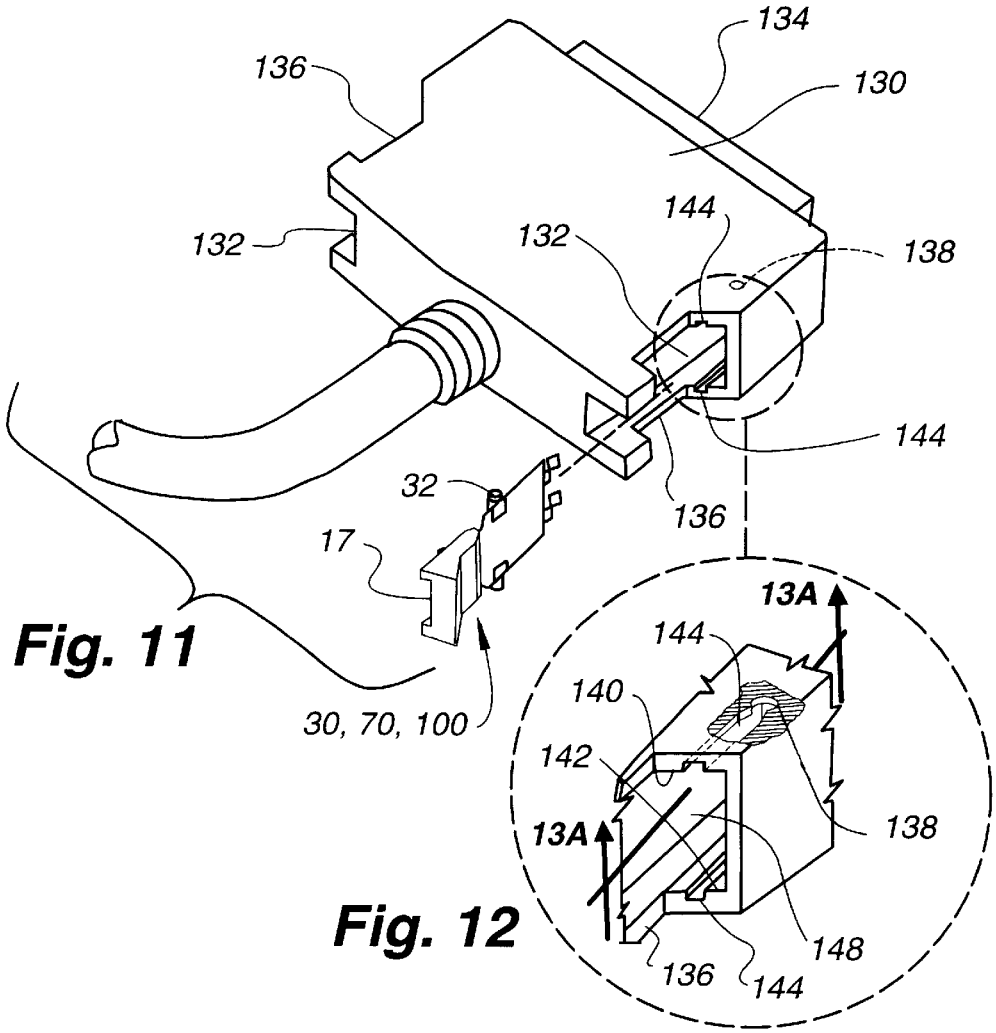
Fig. 11
Fig. 12
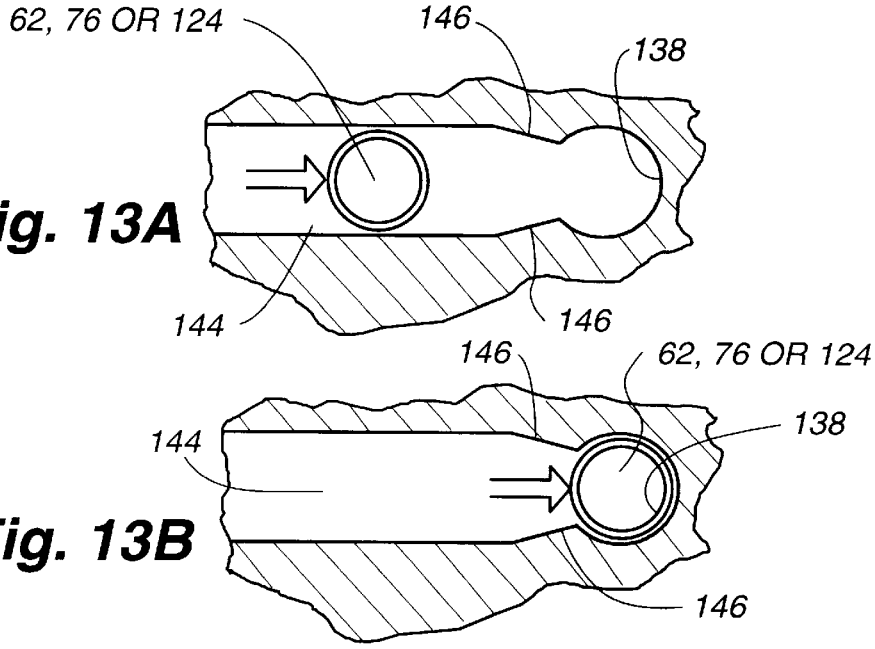
Fig. 13A
Fig. 13B

CABLE CONNECTOR LATCHING DEVICE

CROSS REFERENCE TO RELATED APPLICATIONS

This application claims the benefit of priority of United States Provisional Patent Application Serial No. 60/089,167, filed Jun. 12, 1998, entitled Latching Device For Use With Connecting Cable.

FIELD OF THE INVENTION

The present invention relates to electrical connectors to secure a cable to an electrical receptacle. More particularly, the present invention relates to the latching mechanism which secures a connector to a receptacle and assembly methodology therefore.

BACKGROUND OF THE INVENTION

Electrical connectors which interface between a multi-wire cable and an electrical receptacle have been known in the past. Typically, a cord is connected to a current source or to a computer peripheral item wherein the cord contains wires to carry electrical current. The cable typically has some type of connector at each end which is to be plugged into a mating receptacle. A connector/receptacle interface is common on the back of computer CPUs, and is also common with computer peripheral devices such as printers, monitors, disk drives, etc. There have been numerous patents over the years which have described computer cable connectors. Exemplary connectors are described in U.S. Pat. Nos. 5,167,523, 4,904,202, 5,340,329, 4,702,542, 5,713,752, 5,197,901, 5,741,150 and 5,716,228.

Prior to the present invention, the retention force between the connector and the receptacle has not been made adequately adjustable during connector manufacture. It may be desirable to adjust the force necessary to separate the connector from the receptacle. There may be reasons why a user may want a removal force that is very high, i.e., a great amount of force is required to separate the connector from the receptacle. Conversely, there may be a reason to have a very low retention force, i.e., the amount of force required to separate the connector from the receptacle is very low.

Prior to the present invention, there was not an electrical connector which allowed easy adjustment of the retention force during manufacture.

The prior art also describes numerous connectors which require a pin to retain the pivot arm of the connector. The assembly of this pin requires the step of inserting a small pin through a number of apertures. This assembly step results in additional time and expense. Thus there is a need for a connector which has an improved pivot arm securing assembly.

SUMMARY OF THE INVENTION

The present invention is an improved design of a latching device for use on cable connectors. A first aspect of the invention includes an angled guide on the spring clip which allows the mechanical connection to be made into the receptacle without depressing a pivot arm on a latching device. The angle of the angled guide is adjustable during manufacture such that the desired insertion force may be set. The angled guide may be adjusted such that there is a high insertion force or a low insertion force or a variable force along its length depending on the particular angle chosen with reference to the direction of insertion of the connector. The connector in accordance with the invention has two latching devices, one on each side of the generally rectangular connector, adjacent the one, two or three rows of connector pins and/or pin sockets.

Another aspect of the invention includes a connector with an improved latch assembly. Generally, the latch assembly is a formed piece of sheet metal with a molded thumb button snap fit onto one end of the formed piece of sheet metal and latch arms extending from the other end of the piece of sheet metal. The spring latch assembly is retained within the connector in one embodiment by the use of a spring clip pivot pin which is assembled into the spring latch mechanism and then inserted into a channel in the connector body and captured therein by the pivot pin engaging corresponding apertures in the connector body. The spring clip pivot pin is shaped in such a manner that its opposing ends are compressed by the channel walls during insertion of the latch mechanism into the channel. When the spring clip is positioned fully within the channel, the spring clip snaps in place into apertures in the channel walls which retain the ends of the spring and thus act as a pivot for the latch assembly.

In a second embodiment of the present invention, there is no separate spring clip. Instead, two pairs of spaced longitudinal cuts are made in the sheet metal blank forming the latch and the portions between the cuts are bent outward in opposite directions to form a pivot pin sleeve on each latch member. A separate pivot pin is then inserted in the sleeve. A pair of oppositely facing blind slots are formed in the opposing upper and lower side walls of a rectangular channel in the connector body receiving the latch assembly. These blind slots each receive one of the opposite ends of the pivot pin as the latch assembly is inserted into the channel. Each of these facing slots has a constriction adjacent the blind end of the slot which elastically deforms to permit passage of the pivot pin end past the constriction to hold the pin end in a snap fit fashion against the blind end. The walls of the slots in the channel through the connector body thus capture the pivot pin in position at the end of the slots, permitting the latch mechanism to pivot in the channel about the captured pivot pin.

In a third embodiment of the present invention, there is no separate spring clip or pin to retain the latch assembly in the connector, although the connector body is formed as just described with oppositely facing blind slots in the connector channel and constrictions adjacent the blind ends of the slots. In this embodiment, the latch member is a unitary sheet metal body with pivot pins formed of side portions of the sheet metal body rolled to form opposing rolled pins on opposite sides of the latch member. The pins are shaped and sized to extend into a pair of blind slots in the side walls of and past a constriction near the end of the blind channels, thus securing the latch assembly in the connector body. The unitary latch body assembly is inserted into the channel of the connector in the same manner as the embodiment described above, but is retained within the molded connector channel by the constriction interfering with the backward passage of the posts.

These and other features, advantages and objects of the invention will become more apparent from a reading of the following detailed description of the invention when taken in conjunction with the accompanying drawing.

BRIEF DESCRIPTION OF THE DRAWING

FIG. 11 is a perspective view of a connector in accordance with the present invention showing one of the latching assemblies prior to insertion of the assembly into one channel in the connector body.

FIG. 12 is an enlarged view of the channel portion of the connector shown in FIG. 11 with portions broken away and sectioned to show the constriction at the blind end of the upper slot in the channel.

FIGS. 13A and 13B illustrate enlarged cross sectional views of the closed slot in the connector channel and the pivot pin of the latch assembly as it is inserted in the blind slot in the channel shown in FIG. 12.

DETAILED DESCRIPTION OF THE INVENTION

Figure 1:
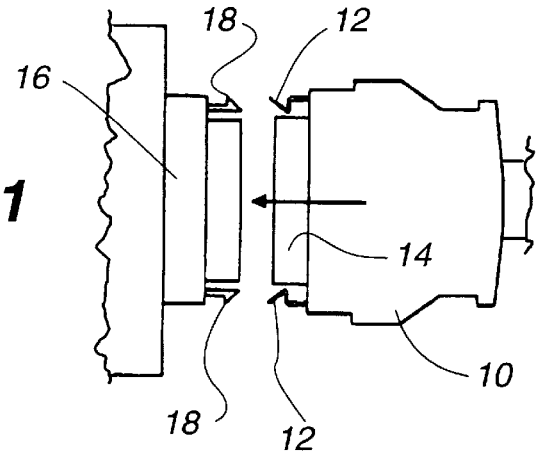
FIG. 1 is a schematic representation of a cable connector positioned to be attached to a receptacle using the spring latch assembly of the present invention.

The present invention describes a number of improvements for a latching device to be used on a cable connector. A typical cable connector as envisioned in the present invention is shown in FIG. 1 as 10. The cable connector 10 is typically made of a molded polymer, but may be any material which interfaces with the receptacle 16. The cable connector 10 typically has some type of latch system or assembly shown as 12 which is adjacent the mating end of the cable connector 14. The latch 12 of the present invention is shown in FIG. 1. This latch 12 will be described in more detail below. The mating end 14 is typically some type of metallic or plastic material which securely connects with the mating end of the receptacle 16 shown in FIG. 1. This receptacle 16 typically may be found on the back of a personal computer CPU, printer, fax machine, or other electrical device. The receptacle 16 is designed such that it securely mates with cable connector 10. In the present invention, receptacle 16 has a pair of latch retaining hooks or posts 18 on opposite sides of the receptacle itself. Each latch retaining post 18, as shown below, interfaces with a spring latch 12 on the connector 10 to hold the mating end 14 of the connector 10 securely engaged or mated to the receptacle 16.

Typically, in the past, the force necessary to disconnect the cable connector 10 from the receptacle 16 could not be predictably or adequately adjusted by the manufacturer of the connector. However, it is desirable for the manufacturer to be able to adjust the retention or extraction force between the cable connector 10 and the receptacle 16 to which the connector is designed to mate in order to adapt connector retaining device designs for different specific connector applications.

For the purposes of this description of the present invention, the retention or extraction force is that force which is necessary to disconnect the cable connector 10 from the receptacle 16 without pressing the latch thumb pads 17 on the sides of the connector 10, which deflect the spring latches 12 outward, to disengage the latches from the latch retainer posts 18. In other words, the force is measured by applying force to the cable connector 10 in any direction, generally away from the receptacle 16, until the spring latches 12 disconnect from the latch posts 18 and the connector 10 breaks free of the receptacle 16. The insertion force, on the other hand, is that force which is required to mate the cable connector 10 to the receptacle 16 and engage the latches 12 with the latch retainer posts 18, again, without deflecting the latches 12 by pressing the latch thumb pads 17.

It is desirable to have this retention force adjustable. In an office or home setting, oftentimes a piece of computer equipment may be pulled away from the other equipment. This may happen accidentally if something falls, or may be intentional wherein the computer and/or office is being moved. If the retention force is too high, the cable connector and/or receptacle may become damaged when the two are being pulled apart accidentally. Thus, it is necessary to adjust or set the retention force such that if the cord connected to the cable connector is pulled away from the receptacle for whatever reason, the cable connector and receptacle become disconnected without damaging the receptacle or cable connector or without pulling the equipment to which the receptacle is attached. In other words, when the cable connector cord is pulled, if the retention force is too high, it may pull the CPU or printer off the table as well. Thus, there is a force limit which is desirable to design into a connector latch system such that under typical operating conditions the cable connector and receptacle stay secured, but, when the cable connector begins to be pulled away from the receptacle, for whatever reason, it can disconnect freely.

The preferred retention force in the latching device of the present invention is approximately in the range of about 10 to 35 pounds force. More preferably, the range is about 15 to 25 pounds force.

Figure 2:
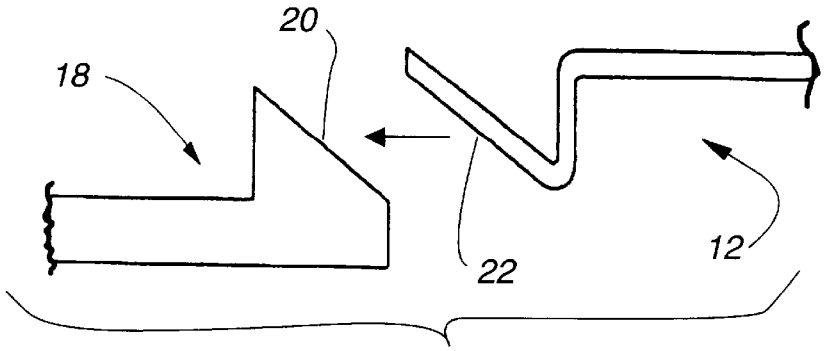
FIG. 2 is an enlarged view of one of the spring latches of the present invention shown in FIG. 1 prior to engagement with a complementary post on a receptacle.
Figure 3:
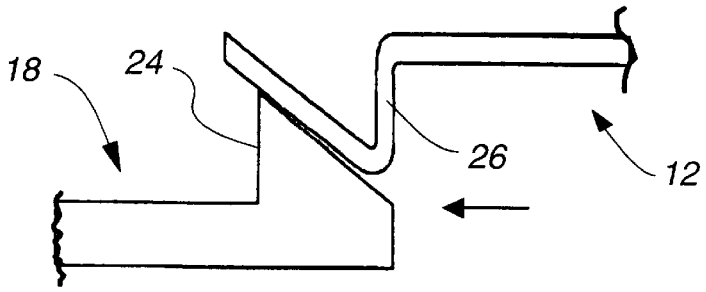
FIG. 3 is an enlarged view as in FIG. 2 with the spring latch engaging and being deflected along a front surface of the complementary post on the receptacle during engagement.
Figure 4:
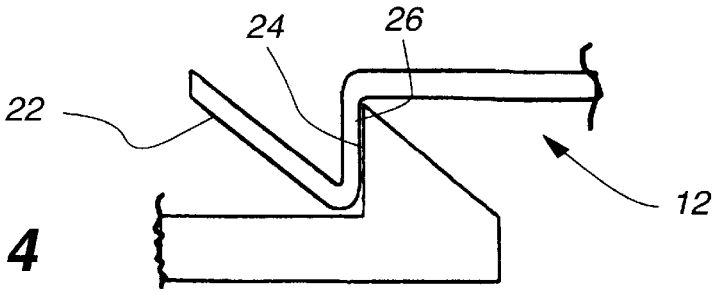
FIG. 4 is an enlarged view as in FIG. 3 with the spring latch fully engaged with the complementary post on the receptacle.

FIGS. 2–4 illustrate the latching procedure of the present invention. FIG. 2 shows the connector mating end 14 positioned to engage with a receptacle 16. In this position, the spring latch assembly 12 is in line with the wedge shaped latch post 18 on the receptacle 16. As the connector 10 engages with the receptacle 16, the spring latch assembly 12 approaches latch post 18 and contacts latch retaining post 18. As is shown in FIG. 3, the spring latch 12 is deflected resiliently outward as it slides along the angled face 20 of the wedge shaped latch post 18. More specifically, the angled face 22 of the spring latch assembly 12 slides along the angled face 20, deflecting the latch assembly 12 outward, until the angled face 22 of the latch assembly 12 clears the angled face 20 and snaps behind the outer end of the face 20 of the post 18. The spring latch 12 is secured to latch post 18 via interference between mating surfaces 24 and 26 which are essentially flat surfaces oriented at right angles to the direction of insertion or removal of the connector 10 from the receptacle 16. This final secured position is shown in FIG. 4. One advantage of this latch assembly 12 is that the connector 10 can be pushed on without having to depress thumb pads 17 as was needed in the prior art designs.

In the present invention, the retention force may be altered by changing the angle of the surface 22 of the spring latch assembly 12 with respect to the direction of removal. As the 90 degree angle shown on the spring latch 12 in FIG. 4 is expanded to greater than 90 degrees, the retention force decreases, thus it is easier to disengage the latch 12 of the connector 10 from the latch retaining post 18 of the receptacle 16. This adjustment also affects the insertion force, which also decreases in this scenario.

Another aspect of the present invention is that the present invention's latch assembly having fewer parts than prior art designs. Many of the prior art patents, cited in the Background of the Invention above, utilize a cable connector wherein latches, although not like latch assemblies 12, each fit into a depression on the receptacle. In order to secure the cable connector to the receptacle, the latch system of the prior art needed to be depressed on the sides. The latch assembly was spring-loaded with a separate spring such that the arms, when pressed, move out and clear the latch post prior to engagement of the spring latch to the latch post. The present invention does not require a separate spring-loaded mechanism, but rather includes a unitary flexible spring latch member which can engage the latch retaining post of the receptacle.

Another aspect of the present invention is the use of a spring clip. In typical manufacturing of a cable connector, the spring latch is secured to the cable connector via a straight pivot pin. The manufacturing step involves inserting the spring latch into the cable connector and, perpendicular to the latch, a pivot pin is inserted through the cable connector housing and through an aperture in the spring latch thus securing the spring latch to the cable connector. The problem with this construction is it involves a difficult alignment procedure wherein a very small pin must be placed accurately through three aligned apertures: two in the cable connector body and at least one in the spring latch. Thus, the present invention also envisions an improved securing system for the spring latch assembly to the cable connector.

Figure 5:
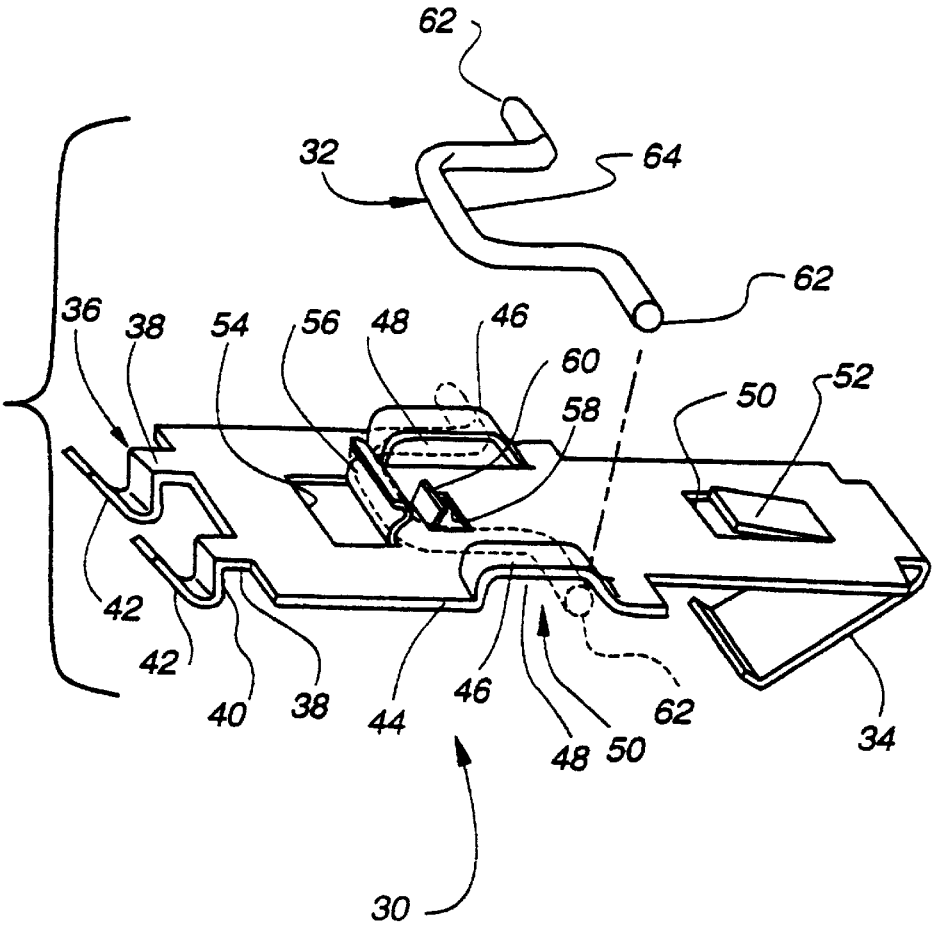
FIG. 5 is a first embodiment of a latching device according to the present invention utilizing a spring clip pivot pin member.

FIG. 5 is a perspective view of a latch member 30 in a first embodiment of a latch assembly in accordance with the present invention. In this figure, the latch thumb pad 17 is not shown for clarity of the latch member construction. The latch member 30 is a sheet metal body that is stamped from a single piece of sheet metal. It also accommodates a separate, generally U shaped spring metal pivot pin 32 which snap fits into place as shown by the phantom dashed lines in FIG. 5 and is described more fully below.

The latch member 30 has a spring tab 34 formed at one end and a pair of spaced latch arms 36 extending from the opposite end of the latch member 30. Each of these latch arms 36 has a straight base portion 38, a latching portion 40 preferably bent at about right angles to the base portion 38, and a generally tapered end portion 42 bent back at an acute angle from the latching portion 40. The tapered end portions 42 provide the sliding angled faces 22 mentioned above with reference to FIGS. 2–4. The latching portions 40 correspond to the mating surface 26 on the latch shown in FIG. 4.

The latch member 30 has a central portion 44 that has a laterally spaced pair of cuts forming bent side portions 46 which are bent upward forming a pair of elongated slots 48 which receive opposite ends of the pivot pin 32, described more fully below. A U shaped cut 50 in the rear end of the central portion 44 of the latch member 30 forms a thumb pad retaining tab 52 which is bent upward from the surface of the central portion 44. This tab snap locks the thumb pad 17 in place on the latch member 30 as is shown in FIG. 11. Another U shaped cut 54 in the front end of the central portion 44 permits a curved retainer tab 56 to be bent upward from the surface of the central portion 44. A smaller U shaped cut 58 centrally spaced from the cut 54 permits a stop tab 60 to be bent upward from the central portion 44 of the latch member 30.

The pivot pin 32 is a separate metal rod which is bent to form two coaxial ends 62 and a U shaped central portion 64. The pivot pin 32 is first positioned on the central portion 44 of the latch member 30 as is shown by the phantom lines such that the ends 62 extend through and project from the side slots or elongated sleeves 48. The central portion 64 of the pivot pin 32 is then rotated downward and snap fit into engagement between the stop tab 60 and the retaining tab 56. These tabs hold the pivot pin 32 in correct pivot position with the central portion 64 captured between the stop tab 60 and the retaining tab 56 and the opposing ends 62 extending laterally outward from the slots 48 approximately at the mid point of the latch member 30. The slots 48 are elongated to permit the pivot pin 32 to be easily inserted therein. First one end 62 is inserted into one slot 48 and then the other end 62 slipped into the other slot 48. The central portion 64 is then rotated so as to position the pin 32 flat against the surface of the central portion 44 and latched into position as shown by the phantom dashed lines in FIG. 5.

Figure 6:
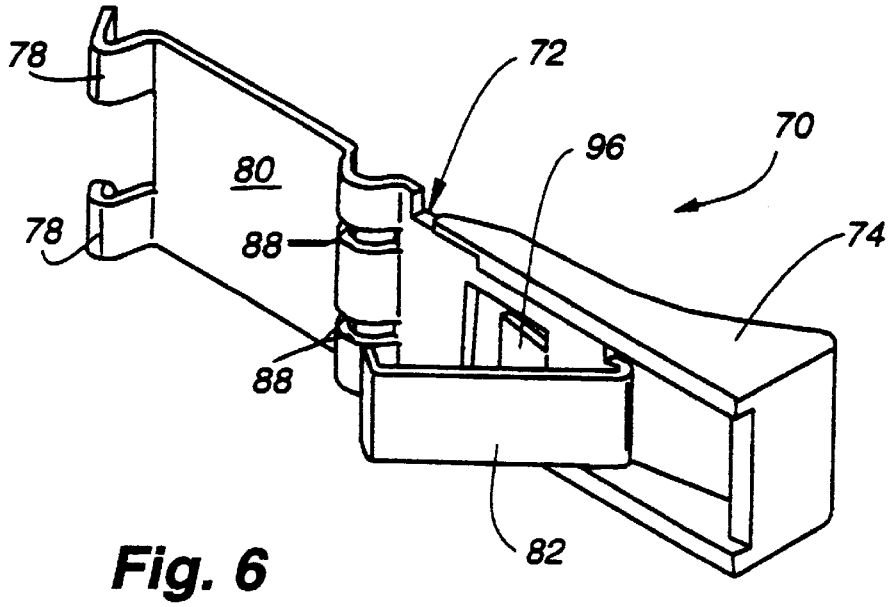
FIG. 6 is a perspective view of a second embodiment of the latch assembly in accordance with the present invention.
Figure 7:
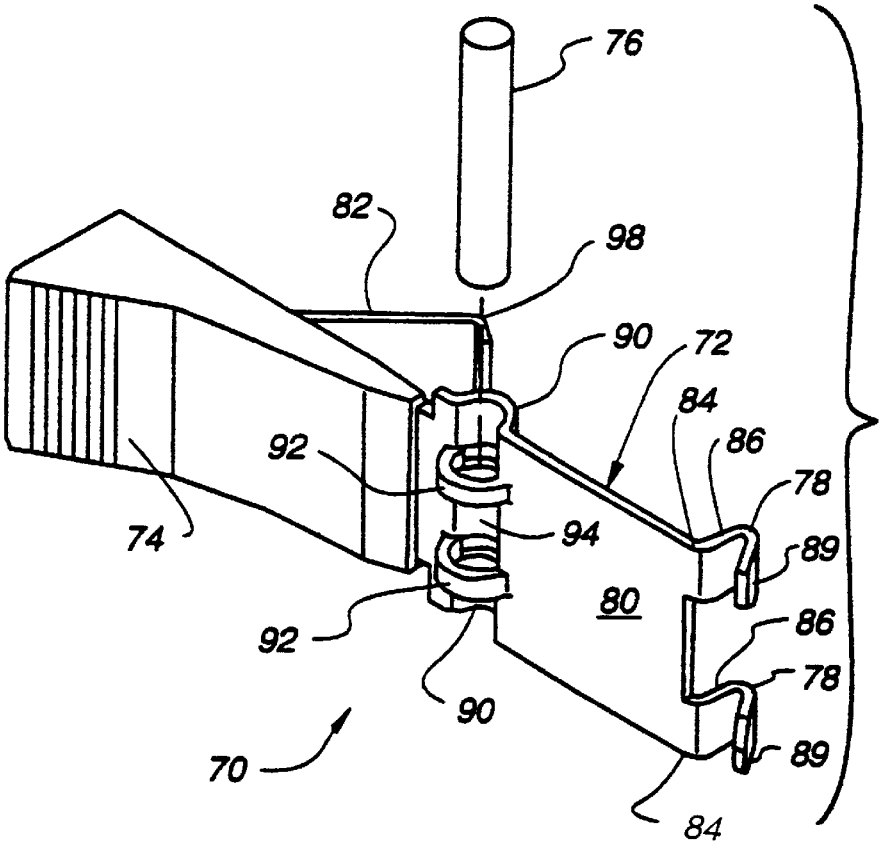
FIG. 7 is an opposite side perspective view of the latch assembly shown in FIG. 6.

A second embodiment of the latch assembly 70 in accordance with the present invention is shown in FIGS. 6 and 7. The latch assembly 70 comprises a spring latch member 72, a separate molded thumb pad 74 snap fit onto the latch member 72, and a straight pivot pin 76. The latch member 72, as in the first embodiment discussed above, is stamped from a single piece of sheet metal and has a pair of spaced latch arms 78 extending from one end of a central portion 80 and a spring tab 82 extending from the other end of the central portion 80. The spring tab 82 is bent to an acute angle with respect to the central portion and serves to bias the latch member 72 in the connector as will be described in more detail with reference to FIGS. 11 and 12 below.

Each latch arm 78 has a generally short straight portion 84, a latch portion 86, and a tapered end portion 89 which have the same functions as above described with reference to the first embodiment of the latch member 30. More specifically, the latch portion 86 is preferably bent at about a right angle to the straight portion 84 and the central portion 80 of the latch member 72. The surface finish of the latch portion 86 and the angle of the latch portion 86 determine the release force required to disengage the connector from the latch post 18 as above described.

The main difference between the first and second embodiments 30 and 70 lies in the pivot construction. The second embodiment 70 utilizes a straight pivot pin 76 while the first embodiment utilized a U shaped spring pin 32. The central portion 80 of the latch member 72 in the second embodiment has two spaced pairs of short parallel cuts 88 parallel to the longitudinal axis of the latch member. These cuts 88 form five sleeve bearing sections 90, 92 and 94 which are alternately bent outward in opposite directions from the flat surface of the central portion 80 to create a transverse pivot sleeve or tube which receives the pivot pin 76 transverse (at right angle) to the longitudinal axis of the latch member 72.

The central portion 80 also has a U shaped cutout defining a retaining tab 96 for interfering with the removal of the thumb pad 74 once the pad 74 is slid onto the latch member 72. This retaining tab 96 is bent away from the central portion 80 and in an opposite direction away from the spring tab 82 so as to snap fit into a complementary groove in the underside of the thumb pad 74.

The spring tab 82 on the rear end of the latch member 72 preferably has a transverse bend 98 forming a smooth linear rocker surface for riding on the inner surfaces of the connector into which the latch assembly is inserted. The pivot pin 76 is sized to project outward from the sleeve bearing sections 90, 92 and 94 and to ride in apertures in the connector body such that the latch member rotates about a stationary pivot pin 76 with the spring tab 82 biasing the thumb pad 74 away from the connector body and the latch arms into engagement with a complementary latch post 18.

Figure 8:
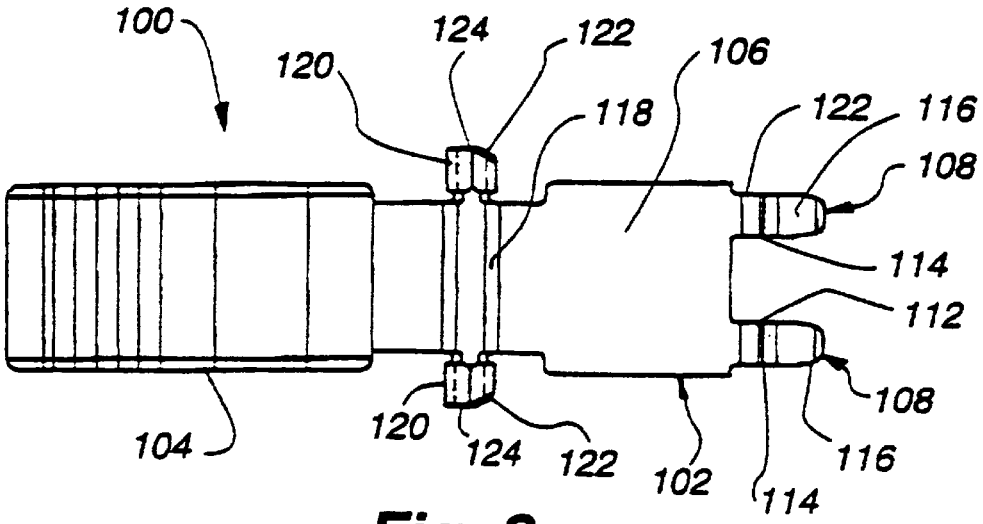
FIG. 8 is a top view of a third embodiment of the latch assembly of the present invention.
Figure 9:
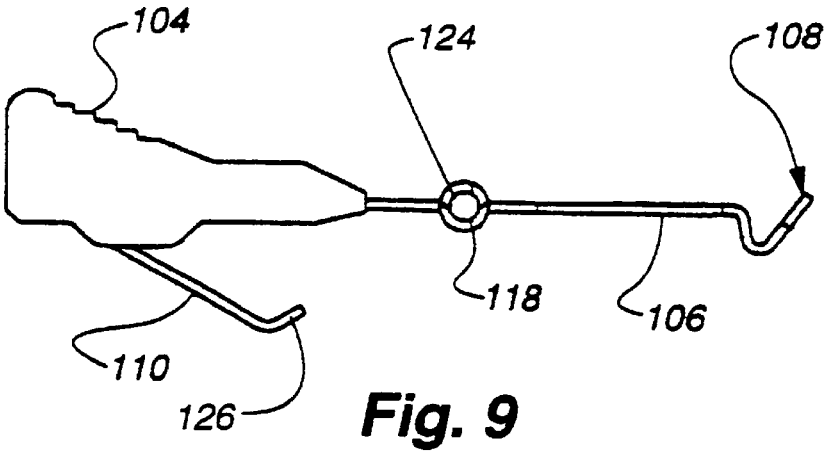
FIG. 9 is a side view of the assembly shown in FIG. 8.
Figure 10:
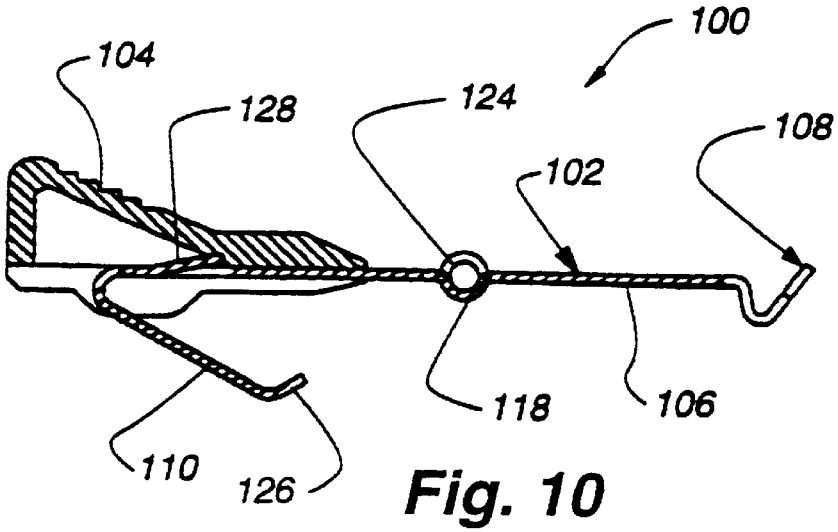
FIG. 10 is a longitudinal cross sectional view of the third embodiment of the latch assembly taken along the line 10—10 in FIG. 8.

A third embodiment 100 of the latch assembly in accordance with the invention is shown in FIGS. 8, 9, and 10. In this embodiment, the pivot pin 76 or spring pivot pin 32 is completely dispensed with. In this embodiment, the pivot pin is integrally formed from the sheet metal forming the latch member itself, thus eliminating one part from the manufacturing process. Referring now to FIGS. 8, 9, and 10, a top side, and longitudinal sectional view of a latch assembly 100 is respectively shown. The assembly 100 comprises a latch member 102 and a thumb pad 104. Again, the latch member 102 has a central portion 106, a pair of spaced latch arms 108 extending from one end of the central portion 106, and a spring tab 110 extending from the other end of the central portion 106. As in the other embodiments, the latch arms each have a short straight portion 112, a latch portion 114 bent at about right angles to the central portion 106 for engaging a latch post 18, and a tapered end portion 116 for deflecting the latch member 102 away from the latch post 18 as previously described when the connector is being inserted into the receptacle.

In this embodiment, the central portion 106 has a pair of parallel opposite bends forming a transverse channel 118 having a generally semicircular cross section located at the pivot point along the longitudinal axis of the latch member 102. In addition, a generally "T" shaped tab is formed in the central portion 106 at both ends of the transverse channel 118. The top "ears" 120 and 122 on the T shaped tab are bent in opposite directions so as to curve toward each other to form a short tube 124 at each end of the channel 118.

These tubes 124 take the place of the straight pivot pin 76 in the second embodiment 70 and the spring pin 32 in the first embodiment. The front "ear" 122 is tapered to present a forward bevel to facilitate smooth entry of the latch member 100 into the closed slot in the channel in the connector.

The spring tab 110 on the rear end of the latch member 102 is bent to an acute angle to the longitudinal axis of the latch member 102 and includes a bent tip 126 to provide a smooth bearing surface at the bend for engaging the connector body to bias the rear of the latch assembly 100 outward. The central portion 106 adjacent the spring tab 110 includes a lock tab 128 which is bent upward opposite to the spring tab 110 for engaging with a shoulder in the thumb tab 104 when the thumb tab 104 is slipped on to the rear end of the latch member 102.

Referring now to FIGS. 11, 12, and 13, a further aspect of the present invention will be described. FIG. 11 shows a perspective view of a cable connector 130 and one of the latch assemblies 30, 70, or 100 ready for insertion into one of a pair of channels 132 in the connector 130. The channels 132 are formed on opposite sides of the connector 130 and on opposite ends of the row or rows of pins/sockets 134. The connector 130 also has a recess cutout 136 through the rear of the channel 132 for receiving the thumb tab 74 or 104 and making the thumb tab accessible by the user who typically will grip the connector 130 via the thumb tabs 74 or 104. A bore 138 vertically through the connector and through the channel 132 at the pivot location for the latch assembly 70 is optionally provided.

The channel 132 is a rectangular longitudinal bore through the body of the connector 130 which extends parallel to the axis of connector insertion into the receptacle (not shown in FIG. 11, but schematically shown in FIG. 1). Each of the channels 132 has a top wall 140 and an opposite bottom wall 142 parallel to the top wall 140. Each wall also has a longitudinally extending flat bottomed blind slot 144 extending from the rear of the channel 132 to the pivot point at the bore 138. Each slot 144 further has a constriction 146 formed by a narrowing of the sides of the slot 144 adjacent the bore 138 forming the end of the blind slot 144.

The blind ends of the slots 144 are best shown in FIGS. 13A and 13B. The body of the connector 130 is preferably made of a semi-rigid plastic material. As such, the sides of the slots 144 forming the constriction 146 can be elastically compressed by the pins 62, 76, or 124 as the latch assembly 30, 70 or 100 is inserted as shown by the arrows in FIGS. 13A and 13B through the channel 132 to the bore 138 forming the blind end of the slot 144. Once the pins are at the ends of the slots 144, the compressed material of the constriction 146 expands to retain the latch assembly in position at the correct pivot point location. In this correct position, the thumb pads 17, 74, or 104 will project from the recess or cutout 136 with the spring tabs 34, 82, or 110 engaging the channel side wall 148 to bias the thumb tabs outward and the latch arms inward.

The through bore 138 may be eliminated in the connector 130 and simply replaced by a circular end to the blind slot 144. However, the through bore 138 is preferred when the spring pin 32 in the first embodiment of the latch assembly 30 is utilized. In this particular instance, the constriction 146 may also be eliminated because the ends 62 of the spring pin 32 will snap outward into the bore 138, thus locking the latch assembly in correct position with the latch member 30 free to pivot. Alternatively, the connector 130 may be constructed with the constrictions 146 and without the through bores 138. In this alternative, the blind bores 144 would simply have a generally circular end as shown in FIGS. 12 and 13. Each of the latch assembly embodiments 30, 70 and 100 would operate and be held in place in the same manner in this alternative, with the constriction 146 retaining the pivot pins in position.

In each of the embodiments described above, the latch arms each have a retaining portion bent at about right angles to the straight portions. The retaining portion angle with respect to the direction of connector insertion determines the retention force necessary to disengage the connector. The force may be selected by the manufacturer simply by choosing the angle appropriately. For example, if a low retention force is desired, the retaining portion would be bent at an angle greater than 90 degrees from the straight portion. As the angle increases, the retention force decreases.

Also, in each of the embodiments described above, the latch arms each have an end portion bent such that the latch member is deflected outward as the connector is inserted into the receptacle until the latch retaining portion snaps over the post 18 as the connector and receptacle are fully engaged. The insertion force may be minimized by making the angle between the end portion and the direction of connector insertion small. Also, the stiffness of the spring tab may be selected by changing the width of the spring tab cutout and/or choice of sheet metal material to arrive at the desired insertion forces for the particular application.

While the invention has been particularly shown and described with reference to several preferred embodiments thereof, it will be understood by those skilled in the art that various other changes in the form and details may be made without departing from the spirit and scope of the invention.

What is claimed is:

1. A latch assembly for use in a cable connector adapted to mate with a complementary receptacle having a latch post, said latch assembly engaging said latch post when said connector and receptacle are mated, said latch assembly comprising:

a sheet metal latch body having a flat central portion, at least one latch arm extending from one end of said central portion and a spring tab extending from an opposite end of said central portion; and a pivot means on said central portion adapted to be mounted in said connector for rotatable supporting said latch body in said connector, wherein said pivot means comprises a plurality of spaced parallel cuts through said central portion and a plurality of bends in said central portion between said cuts forming a transverse pivot sleeve and a pivot pin rotatably received in said sleeve, wherein said pin is adapted to be held in said connector such that said latch member may be rotated about said pivot pint;

wherein said latch arm has a bent latch portion bent at a selectable angle from a direction of insertion of said connector to said receptacle, and wherein said latch arm further comprises a front end portion bent at another angle from said direction of insertion for engaging said latch post and deflecting said latch arm from said latch post as said connector and receptacle are mated.

2. The latch assembly according to claim 1 wherein said pivot pin comprises a spring rod member having a U shaped central portion and a pair of oppositely and coaxially extending pin ends each adapted to be received in one of said sleeves.

3. The latch assembly according to claim 2 wherein said central portion of said latch member has at least one cutout forming a retainer tab bent to retain said U shaped central portion of said spring rod member against said central portion of said latch member when said pin ends are positioned in said sleeves.

4. The latch assembly according to claim 3 wherein each of said sleeves comprises an elongated portion of said central portion of said latch member between a pair of opposite bends, said pin ends being held against one end of said sleeves by said retainer tab.

5. The latch assembly according to claim 4 further comprising a stop tab formed from a portion of said central portion of said latch member bent upward from said central portion toward said retainer tab.

6. The latch assembly according to claim 1 wherein said pivot pin is a straight rod and said sleeve formed in said central portion of said latch member comprises a plurality of oppositely projecting bent portions forming a transverse round tubular sleeve receiving said straight rod therethrough.

7. The latch assembly according to claim 6 wherein said spring tab has a transverse bend forming a bent end with said bend adapted to engage said connector instead of said bent end.

8. A multi-pin cable connector for mating with a complementary multi-pin receptacle in an insertion direction comprising:

a connector body adapted to carry a plurality of conductors, said connector body having a pair of parallel channels on opposite sides of said body, each channel having an upper wall and a lower wall and opposing side walls, each channel adapted for receiving therein a latch assembly including a latch member and a transverse pivot pin, said connector body further having a blind slot terminating at a predetermined pivot location in at least one wall of each of said channels for receiving therein said pivot pin, said blind slot having a constriction adjacent said pivot location for retaining said pivot pin in said pivot location.

9. The connector according to claim 8 wherein said upper and lower walls each have a blind slot therein for receiving said pivot pin.

10. The connector according to claim 9 wherein each blind slot has a constriction adjacent said pivot location.

11. The connector according to claim 8 further comprising said connector body having a through bore at said pivot location extending through said channel.

12. A multi-pin latching cable connector for mating with a complementary multi-pin receptacle in an insertion direction comprising:

a connector body adapted to carry a plurality of conductors, said connector body having a pair of parallel channels on opposite sides of said body, each channel having an upper wall and a lower wall and opposing side walls; and a pair of latch assemblies captured in said channels, each including a latch member formed from a piece of sheet metal cut and bent to form at least one latch arm extending from one end of an elongated central portion, a spring tab extending from the other end of said central portion, and a pair of T shaped portions extending laterally from said central portion wherein ends of said T shaped portions are bent to form short coaxially aligned pivot pins on opposite sides of said central portion, wherein each channel has a blind slot terminating at a predetermined pivot location in at least one wall of each of said channels for receiving therein one of said pivot pins, said blind slot having a constriction adjacent said pivot location for retaining said pivot pin in said pivot location.

13. The connector according to claim 12 wherein each of said upper and lower walls has a blind slot therein terminating at said predetermined pivot location.

14. The connector according to claim 13 wherein said latch member further comprises a pair of latch arms extending from said central portion.

15. The connector according to claim 14 wherein each of said latch arms has a latch portion bent at an angle from said insertion direction.

16. The connector according to claim 13 wherein said latch arm has a latch portion bent at a selectable angle from said insertion direction, said angle being selected to provide a predetermined retention force on said connector when said connector is latched to a corresponding receptacle.

17. The connector according to claim 16 wherein each latch assembly comprises a pair of latch arms extending from said central portion.

18. The connector according to claim 17 wherein each channel has a pair of blind slots and each said blind slot has a constriction adjacent said pivot location for retaining said pivot pin in said pivot location.

* * * * *